US006103058A

United States Patent [19]

Engström

[11] Patent Number: 6,103,058

[45] Date of Patent: Aug. 15, 2000

[54] METHOD FOR THE CONTINUOUS COOKING OF PULP

[75] Inventor: Johan Engström, Karlstad, Sweden

[73] Assignee: Kvaerner Pulping AB, Sweden

[21] Appl. No.: 09/060,954

[22] Filed: Apr. 16, 1998

Related U.S. Application Data

[63] Continuation-in-part of application No. 08/908,285, Aug. 7, 1997.

[51] Int. Cl.[7] ..... D21C 3/26

[52] U.S. Cl. ..... 162/19; 162/37; 162/39; 162/40; 162/41

[58] Field of Search ..... 162/19, 37, 39, 162/40, 41, 43, 47

[56] References Cited

U.S. PATENT DOCUMENTS 5,089,086 2/1992 Silander ..... 162/37

FOREIGN PATENT DOCUMENTS 9001467 4/1990 Sweden .

*Primary Examiner*—Dean T. Nguyen
*Attorney, Agent, or Firm*—Fasth Law Offices; Rolf Fasth

[57] ABSTRACT

This invention relates to a new and improved way of continuously cooking fiber material in an over loaded digester, wherein temperatures and alkaline levels are controlled to be maintained within specific levels in different zones of the digesting process in order to optimize chemical consumption and heat economy and, at the same time, to achieve very good pulp properties.

32 Claims, 12 Drawing Sheets

METHOD FOR THE CONTINUOUS COOKING OF PULP

PRIOR APPLICATION

This is a continuation-in-part application of U.S. patent application Ser. No. 08/908,285, filed Aug. 7, 1997.

TECHNICAL FIELD

The present invention relates to a novel method for producing pulp, preferably sulphate cellulose, with the aid of a continuous cooking process.

BACKGROUND INFORMATION AND SUMMARY OF THE INVENTION

Environmental demands has forced our industry to develop improved cooking and bleaching methods. One recent breakthrough within the field of cooking is ITC™, which was developed in 1992–1993. ITC™ is described in WO-9411566, which shows that very good results concerning the pulp quality may be achieved. ITC™ is mainly based on using almost the same temperature (relatively low temperature compared to the prior art) in all cooking zones in combination with moderate alkaline levels. The ITC™-concept does not merely relate to the equalization of temperatures between different cooking zones, but a considerable contribution of the ITC™-concept relates to enabling an equalized alkaline profile also in the lower part of the counter-current cooking zone.

Moreover, it is known that impregnation with the aid of black liquor can improve the strength properties of the fibers in the pulp produced. The aim of the impregnation is, in the first place, to thoroughly soak each chip so that it becomes susceptible, by penetration and diffusion, to the active cooking chemicals which, in the context of sulphate cellulose, principally consist of sodium hydroxide and sodium sulphide.

If, as is customary according to the prior art, a large proportion of the white liquor is supplied in connection with the impregnation, there will exist no distinct border between impregnation and cooking. This leads to difficulties in optimizing the conditions in the transfer zone between impregnation and cooking.

Now it has been found that surprisingly good results can be achieved when:

1. Keeping a low temperature but a high alkali content in the beginning of a concurrent cooking zone of the digester;

2. Withdrawing a substantial part of a highly alkaline spent liquor that has passed through at least the concurrent cooking zone; and 3. Supplying a substantial portion of the withdrawn spent liquor that has a relatively high amount of rest-alkali, to a point that is adjacent the beginning of an impregnation zone.

This leads to a reduced H-factor demand, reduced consumption of cooking chemicals and better heat-economy. Additionally, the novel method leads to production of pulp that has a high quality and a very good bleachability, which means that bleach chemicals and methods can be chosen with a wider variety than before for reaching the desired quality targets (brightness, yield, tear-strength, viscosity, etc.) of the finally bleached pulp.

Furthermore, we have found that these good results can also be achieved when moving in a direction opposite the general understanding of the ITC™-teaching, in connection with digesters having a counter-current cooking zone. Instead of trying to maintain almost the same temperature levels in the different cooking zones, we have found that when using a digester that has both a concurrent and a counter-current cooking zone, big advantages may be gained if the following basic steps are used:

1. Keeping a low temperature but a high alkali content in the concurrent zone of the digester;

2. Keeping a higher temperature but a lower alkali content in the counter-current zone;

3. Withdrawing a substantial part of the highly alkaline spent liquor that has passed through at least one digesting zone; and 4. Preferably supplying almost all of the withdrawn spent liquor, that has a relatively high amount rest-alkali, to a position that is adjacent the beginning of the impregnation zone.

Also, in connection with digesters of the one-vessel type (without a separate impregnation vessel), surprisingly good results are achieved when the basic principles of the invention are used. The good results also apply to digesters having no counter-current zone and to overloaded digesters that cannot be provided with a sufficient supply of wash liquor to enable a sufficient up-flow for counter-current cooking.

Moreover, preliminary results indicate that the preferred manner of using the invention may be somewhat modified also in other respects but still achieving very good result, e.g., by excluding the counter-current cooking zone. Additionally, expensive equipment might be eliminated, e.g., strainers in the impregnation vessel, hanging central pipes, etc., making installations much easier and considerably less expensive.

DETAILED DESCRIPTION

Figure 1:
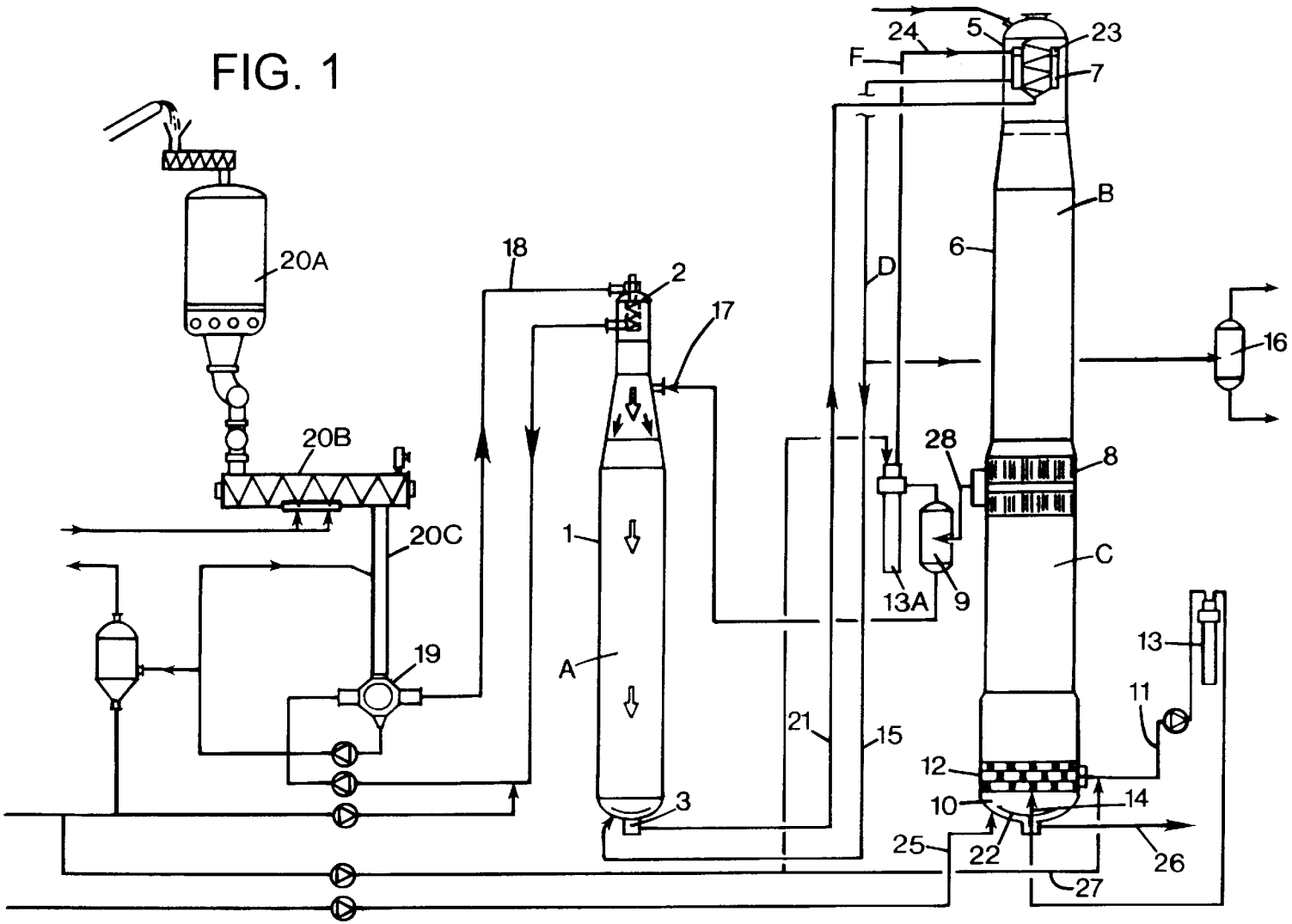
FIG. 1 is a schematic flow diagram of an embodiment of a digester system according to the basic principles of the present invention.

FIG. 1 shows a preferred embodiment of a two vessel steam/liquid-phase digester for producing chemical pulp according to the invention. The main components of the digesting system consist of an impregnation vessel 1 and a steam/liquid-phase digester 6.

The impregnation vessel 1, which normally is totally liquid filled, possesses a feeding-in device 2 at the top, which feeding-in device may be a top separator with screw-feed device which feeds the chips in a downward direction at the same time as transport liquid is drawn off. The details of this top separator are described below. At the bottom, the impregnation vessel possesses a feeding-out device 3 comprising a bottom scraper. In addition, there is a conduit 17 in fluid communication with the impregnation vessel for adding hot black liquor. As best seen in FIG. 1, the black liquor is preferably supplied at the top of the impregnation vessel. In contrast to conventional black liquor impregnation vessels, no draw-off screen is located on the impregnation vessel. However, such draw-off may be provided, if so desired.

The chips are fed from a chip bin 20A, through a steaming vessel 20B and into a chip chute 20C. A feeding device, preferably a high-pressure feeder 19, feeds the chips via a conduit 18 to the top of the impregnation vessel 1. The feeder 19 is arranged in a known manner to the chute, and is connected to the necessary liquid circulations and replenishment.

Figure 2:
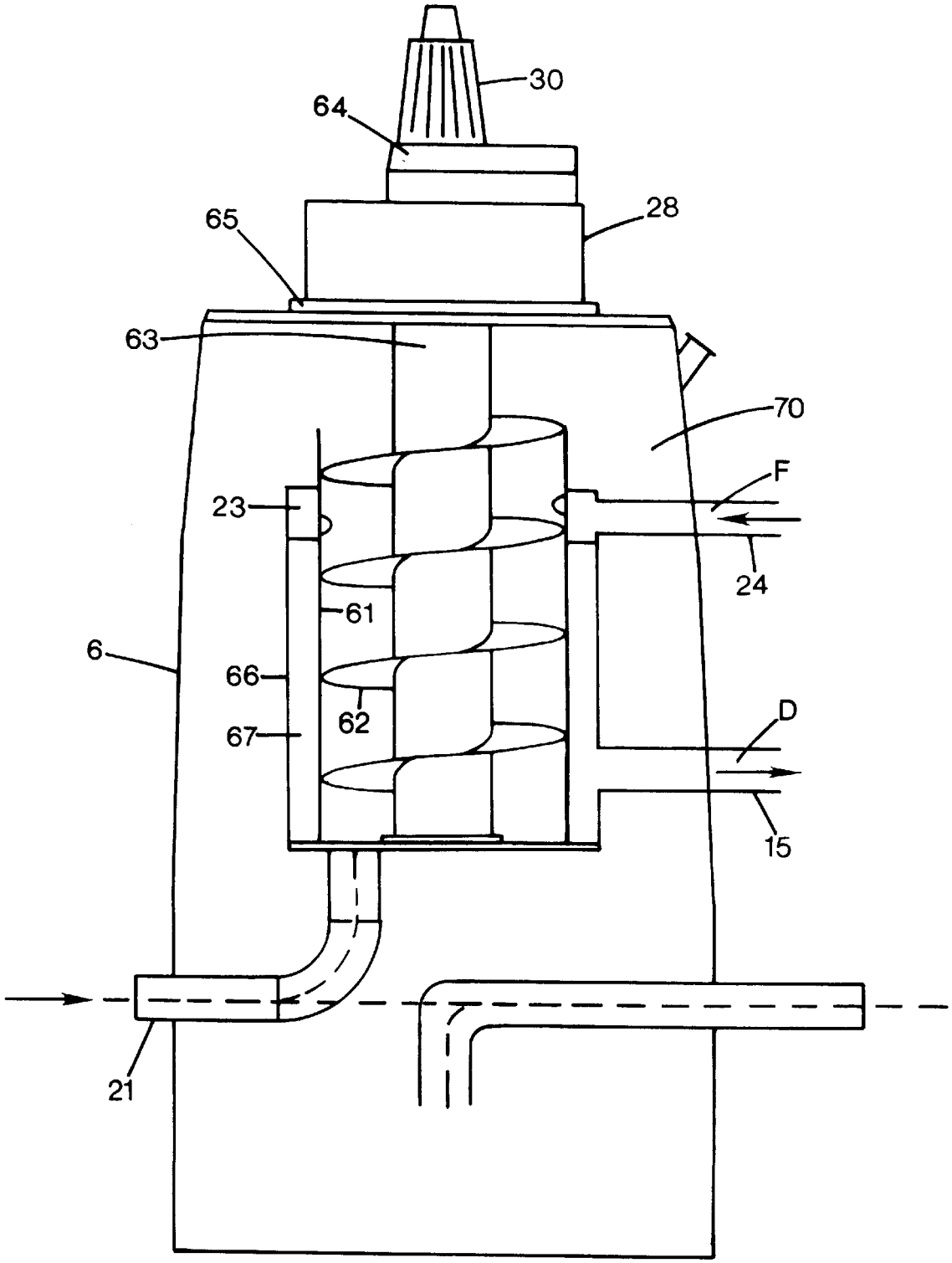
FIG. 2 is a cross-sectional view of a preferred first embodiment of a top separator according to the present invention.

A conduit 21 for transporting chips extends from the bottom of the impregnation vessel 1 up to a top portion 5 of the digester 6 having a steam space, wherein the liquid level is indicated by a dashed line. A supply line for supplying steam to the top portion 5 provides for heating of the steam space. As best seen in FIG. 2, the conduit 21 opens out at the bottom of a top separator 7 which may feed the chips by means of a screw in an upwardly moving direction. A screen of the separator is used to draw off the liquid D (which is then returned in the return line 15) together with which the chips are transported up to the top. At the upper edge of the screen (over which edge the chips tumble out), there is arranged an integrated annular ring 23. The annular ring 23 is connected to a conduit 24 which (preferably via a heat-exchanger 13A) leads to a white-liquor container (not shown). As best seen in FIG. 1, a screen girdle section 8 is arranged in conjunction with a step-out approximately in the middle of the digester 6. Draw-off from this screen girdle section 8 can be conducted directly via the conduit 17 to the impregnation vessel 1. Preferably, however, the black liquor is drawn off via a conduit 28 to a first flash cyclone 9. The first flash cyclone may be in operative engagement with the heat exchanger 13A to provide steam to the heat exchanger. At the bottom 10 of the digester 6, there is a feeding-out device including one scraping element 22.

According to a preferred alternative, a "cold-blow" process is carried out so that the temperature of the pulp is cooled down at the bottom of the digester with the aid of relatively cold (preferably 70–80° C.) liquid (wash liquid) which is added by means of the scraping element 22 and/or other liquid-adding devices 25 (such as annular pipes) at the bottom of the digester, and then conducted upwards in counter-current. With the aim of being able to produce high-quality pulp having a low and equal kappa number, it is essential to distribute chemicals and heat evenly across the digester, so that all fibers in the column are treated under the same conditions.

This may be achieved by means of a lower circulation 11, 12, 13, 14, a so-called ITC™ circulation. This lower circulation consists of a screen girdle section 12 (in the shown embodiment consisting of three rows) which is arranged just above the lower liquid-addition point 22 and/or 25. In an overloaded digester, it is desirable to position the section 12 close to the washing liquid conduit 25 if there is no or only insubstantial counter-current flow in the zone below the screen girdle section 12. The draw-off from the screen girdle section 12, is recirculated (for displacing black liquor in counter-current to the draw-off screen 8) into the digester with the aid of a stand pipe 14 that extends from the bottom of the digester and opens out approximately on a level with the screen girdle section 12. A heat exchanger 13 for temperature regulation (increasing the temperature of the re-introduced liquid) and a pump are also located in the conduit 11 which connects the screen girdle 12 with the stand pipe 14.

The recirculation loop 11 may also be connected via a branch conduit 27 to the white liquor supply so that fresh alkali can be supplied and, in the form of counter-current cooking, further reducing the kappa number. The digester construction described is notable for the lack of a plurality of central pipes arranged from above and hanging downwards, as well as of feed pipes connected to them and of other necessary parts for the circulations.

A preferred installation according to the invention may function as follows. The chips are fed into the chip bin 20A, subsequently to the steaming vessel 20B and, thereafter, forwarded into the chute 20C. The high-pressure feeder 19 (which may be supplied with about 5% of the total amount of white liquor in order to lubricate the feeder 19), with the aid of which the chips are fed into the conduit 18 together with transport liquid. The slurry of chips and liquid that is fed to the top of the impregnation vessel 1 may have a temperature of about 110° C. to 120° C. on entry to the impregnation vessel 1 (excluding recirculated transport liquor).

In addition to the actual fibers in the wood, the latter also conveys its own moisture (the wood moisture), which normally constitutes about 50% of the original weight, to the impregnation vessel 1. Over and above this, some condensation is present from the steaming, i.e., at least a part of the steam (principally low-pressure steam) which was supplied to the steaming vessel 20B is cooled down to such a low level that it condenses and is then recovered as liquid together with the wood and the transport liquid.

At the top of the impregnation vessel 1, there is a screw feeder 2 that pushes chips from above and downwards into the impregnation vessel 1. Preferably, no liquid is recirculated within the impregnation vessel. Instead, spent liquor that has passed through the first flash tank 9 is supplied. If desired, however, such recirculation may be provided in the impregnation vessel.

The chips which are fed out from the bottom of the top screen 2 then move slowly downwards in a plug flow through the impregnation vessel 1 in a liquid/wood ratio between 2/1–10/1 preferably between 3/1–8/1, more preferred of about 4/1–6/1. Hot black liquor, which is drawn off from the first flash tank 9, is added, via the conduit 17, to the top of the impregnation vessel 1. The high temperature of the black liquor (100° C. to 160° C.), preferably exceeding 130° C., more preferred between 130° C. to 160° C., ensures rapid heating of the chips. In addition, the relatively high pH, exceeding pH 10, of the black liquor neutralizes acidic groups in the wood and also any acidic condensate accompanying the chips, thereby, i.e., counteracting the formation of encrustation, so-called scaling.

An additional advantage of the method is that the black liquor supplied into the impregnation vessel has a high content of rest alkali, (EA as NaOH), at least 13 g/l, preferably about or above 16 g/l and more preferred between 13 g/l to 30 g/l at the top of the impregnation vessel 1. This alkali mainly comes from the black liquor due to the high amount of alkali in the concurrent zone C of the digester. Furthermore, the strength properties of the fibers are positively affected by the impregnation because the high amount of sulphide. The major portion of black liquor is directly (or via one flash) fed to the impregnation vessel 1.

A minor amount of the black liquor may be used for transferring the chips from the HP-feeder to the inlet of the impregnation vessel. However, no amount, or only an insubstantial amount, of black liquor is directly transferred to the cooking zones.

The total supply of black liquor to the impregnation vessel exceeds 80% of the amount drawn off from the draw-off strainers 8, preferably more than 90% and optimally about 100% of the total flow, which normally is about 8 to 12 $m^3$/ADT.

The chips, which have been thoroughly impregnated and partially delignified in the impregnation vessel, are then fed to the top of the digester 6 and conveyed into the upwardly-feeding top separator 7. The chips are thus fed upwards through the screen, meanwhile free transport liquid is withdrawn outwardly through the screen and finally the chips fall out over the edge of the screen down through the steam space. Before or during their free fall, the chips are drained with a cooking liquor which is supplied by the conduit 24 into the top separator 7. The white liquor is preferably heated by the heat exchanger 13A that preferably is supplied with heat steam from the flash tank 9.

The quantity of white liquor that is added at the top of the digester 6 depends on how much white liquor possibly is added else where, but the total amount corresponds to the quantity of white liquor that is required for achieving the desired delignification of the wood. Preferably, a major part of the white liquor is added here, i.e., more than 60%, which also improves the diffusion velocity, since it increases in relation to the concentration difference (chip-surrounding liquid). The thoroughly impregnated chips rapidly assimilate the active cooking chemicals by diffusion, since the concentration of alkali (EA as NaOH) is relatively high, at least 20 g/l, preferably between 30 g/l and 60 g/l and more preferred between about 45 g/l and 55 g/l.

The chips then move down into the concurrent cooking zone B and through the digester 6 at a relatively low cooking temperature, i.e., between about 130° C. to 160° C., preferably about 140° C. to 150° C. The major part of the delignification takes place in the concurrent cooking zone B.

The retention time in the concurrent cooking zone should be at least 20 minutes, preferably at least 30 minutes and more preferred at least 40 minutes. The liquid-wood ratio should be at least 2/1 and should be below 7/1, preferably in the range of 3/1 to 5.5/1, more preferred between 3.5/1 and 5/1. The liquid wood-ratio in the counter-current cooking zone C should be about the same as in the concurrent cooking zone B.

The cooking liquid mingled with released lignin, etc., is drawn off at the draw-off screen 8 into the conduit 28. As mentioned above, liquid is also supplied in the lower part of the digester which moves in a counter-current flow direction. It can be described as the pipe 14 displacing it from the wood upwards towards the draw-off screen 8. This results, consequently, in the delignification being prolonged in the digester 6.

The alkali content in the lowermost part of the counter-current cooking zone C should preferably be lower than in the beginning of the concurrent zone B, above 5 g/l, but below 40 g/l. Preferably less than 30 g/l and more preferred between 10 g/l to 20 g/l. In the preferred case, the aim is to have about the same temperature in all cooking zones but sometimes a temperature difference of about 10° C. between the cooking zones may be advantageous. Expediently, the lower circulation 11, 12, 13, 14 is charged with about 5% to 20%, preferably 10% to 15% of the total amount of white liquor. The temperature of the liquid which is recirculated via the stand pipe 14 that is regulated with the aid of a heat exchanger 13 so that the desired cooking temperature is obtained at the lowermost part of the counter-current cooking zone C.

In the preferred case, the cold-blow process is used so that the temperature of the pulp in the outlet conduit 26 is less than 100° C. Accordingly, washing liquid having a low temperature, preferably about 70° C. to 80° C., is added by using the scraping element and an outer annular conduit 25 arranged at the bottom of the digester 6. This liquid consequently displaces the boiling hot liquor in the pulp upwards in counter-current and thereby imparts a temperature to the remaining pulp which can be cold-blown, i.e., depressurized and disintegrated without any real loss of strength.

From tests made in lab-scale, we have found indications that it is desired to keep the alkaline level at above at least 2 g/l, preferably above 4 g/l, in the impregnation vessel 1 in connection with the black liquor, which would normally correspond to a pH of about 11. If not, it appears that dissolved lignin precipitate and even condensate.

In FIG. 2 there is shown a preferred embodiment of a separator to be used in connection with one of the embodiments of steam/liquid phase digester systems disclosed herein. It is often preferred to have an upwardly feeding top separator for a steam/liquid phase digester. The separator may comprise a screen basket 61 in which a rotatable screw feeder 62 is positioned. The screw feeder is fixedly attached to a shaft 63 which at its upper end is fixedly attached to a drive unit 64. The drive unit 64 is attached to a plate 65 which is attached to the digester shell 6.

Circumjacent the screen basket 61 there is arranged a liquid collecting space 67, which may be connected to the return pipe circulation 15. Above the liquid collecting space 67, also circumjacent the screen basket 61, there is arranged a liquid supply space or opening 23 which is connected to the supply line 24 that supplies white liquor. Between the outer peripheral wall 66 of the liquid collecting space 67 and the liquid supply space 23 respectively, and the digester shell 6 at the top, there exist an annular space 70 which opens up down into the upper part of the digester 6. The functioning of the top separator may be described as follows.

The thoroughly heated and impregnated chips are transferred by means of the supply line 21 into the bottom portion of the screen basket 61. Here the screw feeder 62 moves the chips upwardly at the same time as the transport liquid D is separated from the chips, by being withdrawn outwardly through the screen basket 61 and further out of the digester through return line 15. More and more liquid will be withdrawn from the chips during their transport within the screen basket 61. Eventually, the chips will reach the level of the supply space 23. Here the desired amount of cooking liquor, preferably white liquor, is added through the supply space 23, having a temperature and effective alkaline content in accordance with the invention.

In order to eliminate the risk of back flowing of the supplied liquid from the supply space 23 into the withdrawal space 67, a minor amount of free liquid (at least about 0.5 $m^3$/ADT) should be left together with the chips, which free liquid will then be mixed with the supplied cooking liquor. Preferably, about one m3/ADT should be left together with the fiber material. Additionally, the white liquor should be provided at a point that is downstream of the flow of the suspension of the fiber material and the free liquid that is being fed through the screw member.

At the top of the screen basket 61, the chips and the cooking liquor may flow over the upper edge thereof and fall into the steam liquid space 70 and further on to the top of the chips pile within the digester, where the concurrent cooking zone (B) starts.

Figure 3:
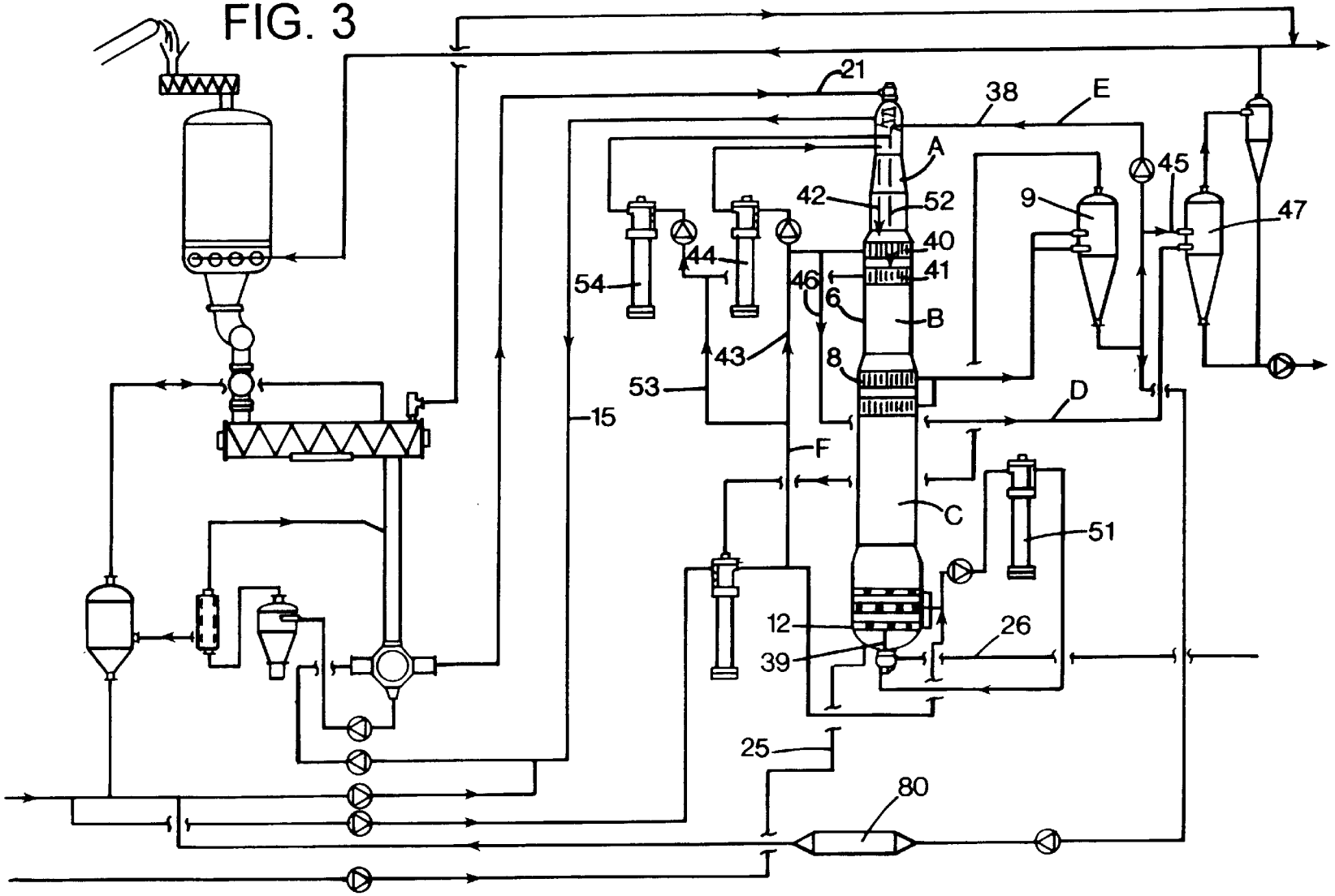
FIG. 3 is a schematic flow diagram of a preferred second embodiment of a digester system according to the present invention.

In FIG. 3, it is shown a preferred embodiment for applying the invention to a single vessel hydraulic digester 6. The same kind of basic equipment before and in connection with the HP-feeder as shown in FIG. 1 is used, which therefore is not described in detail. Withdrawal strainers 8 are arranged in the middle part of the digester 6. The lowermost part of the digester is in principle similar to the one shown in FIG. 1, with a supply line 25 for washing liquid and a blow line 26 for removing the digested pulp from the digester 6. A very short distance above the bottom of the digester 6, there is positioned a strainer arrangement 12 for withdrawing liquid which is heated and to which some white liquor, preferably about 10% of the total amount, is added before it is recirculated by means of a short stand pipe 39, which opens up at about the same level as the lowermost strainer girdle 12.

In the upper part of the digester there are arranged two further strainer sets 40, 41. The upper strainer 40 is arranged for withdrawing liquid which has passed the impregnation zone (A). Some of the withdrawn liquid D is taken out via a conduit 46 to a second flash tank 47. The other part of the withdrawn liquid is recirculated for re-introducing liquid withdrawn by means of a central pipe 42 which opens up at a level adjacent the strainer 40. Before the liquor withdrawn from the strainer 40 is re-introduced, white liquor can be added thereto by means of a supply-line 43 and thereafter the liquid is heated to the desired temperature by means of a heat exchanger 44.

The second strainer 41, which is positioned immediately below the upper strainer 40 but above the withdrawal strainer 8 is a also part of a re-circulation unit.

The liquor that is withdrawn from the strainer 41 is recirculated for re-introducing the liquor by means of a central pipe 52 which opens up at a level adjacent the strainer 41. Before the liquor withdrawn from the strainer 41 is re-introduced, the main portion of the white liquor is added thereto by means of a supply-line 53 and thereafter the liquid is heated to the desired temperature by means of a heat exchanger 54.

The digesting process within a digester shown in FIG. 3 may be described as follows. The slurry of chips and transport liquid is transferred, e.g., by means of high pressure feeder, within the feeding line 21 to the top of the digester where it is introduced into the top of a screen basket 35*s* (see FIG. 4) of the separator, wherein the major part of transport liquid is separated from the chips. Below the separator at supply devices 37*s*, an impregnation liquor E is supplied by means of the supply lines 38*s*. The supply devices 37*s* should be a sufficient distance from the separator to prevent any undesirable back-flowing from occurring. The impregnation liquor may be hot black liquor that is taken from the withdrawal screen 8 via a flash tank 9 by means of the supply conduit 38.

If all the desired liquor amount cannot be withdrawn via the conduit 46 (see FIG. 3) to the flash tank 47, there is provided for the possibility of also withdrawing liquor from the outlet of the first flash tank 9 via a conduit 45. A minor amount of the black liquor withdrawn from flash tank 9 may be used for transferring the chips from the HP-feeder via the conduit 21 to the inlet of the digester 6. This minor flow then has to be cooled in a cooler 80 before it is entered into the feeder. The two flows of black liquor are preferably used to regulate the temperature within the impregnation zone A. In the preferred embodiment, the temperature of the black liquor within the impregnation zone is over 100° C. Preferably, the temperature is between about 120° C. and about 140° C.

The amount of effective alkaline of the black liquor provided in the conduit 38 is relatively high, at least 13 g/l, preferably about 20 g/l, which provides for the impregnation zone (A) to be established without any substantial additional supply of white liquor at this position. The chips are then impregnated and heated when moving down towards the upper screen 40, where the spent liquor (D) is withdrawn and transferred by means of the conduit 46 to the flash tank 47.

The chips are heated and alkali is introduced by means of the above described cooking circulations 40, 42, 43, 44; and 41, 52, 53 and 54 in order to obtain the desired cooking conditions. In the preferred mode, the temperature at the beginning of the concurrent zone B is about 145° C. to 160° C. for soft wood and about 140° C. to 155° C. for hard wood and an alkaline content of about 30 g/l to 55 g/l. Thanks to the exothermic reaction of the chemicals the temperature is slightly further increased when the fiber material is moving downwardly in the concurrent cooking zone B.

Liquid having a relatively high content of effective alkaline is withdrawn at the strainers 8 positioned adjacent the middle section of the digester 6. The alkaline content of this withdrawn spent liquor E would normally exceed 15 g/l.

Also liquor from the counter-current zone C is withdrawn at this withdrawal strainer 8, since the liquor being introduced by means of the stand pipe 39 moves in counter-current upwardly through the concurrent cooking zone C finally reaching these strainers 8. A withdrawal strainer 12 is positioned close to the bottom, as shown in FIG. 3. In the counter-current zone C, the temperature is controlled by means of heating the liquid drawn from the lower withdrawal strainer 12, in a heat exchanger 51 before introducing it through the stand pipe 39. In the preferred case, also a minor amount, about 10% to 15% of the total amount, of white liquor is added to this recirculation line to achieve the desired alkali concentration in the counter-current cooking zone C.

The pulp is then cooled by means of washing liquid 25 that is supplied at the bottom of the digester 6. The washing liquid 25 moves in counter-current upwardly and subsequently is withdrawn at the strainer 12. The cooled finally digested pulp, is then taken out of the digester into the blow-line 26.

As already mentioned, pulp produced in this manner has a higher quality and better bleachability than pulp produced with known methods. In lab-scale tests, we have found that about 10 kg of active chlorine can be saved for reaching full brightness (about 90% ISO), compared to a conventionally cooked pulp.

Figure 4:
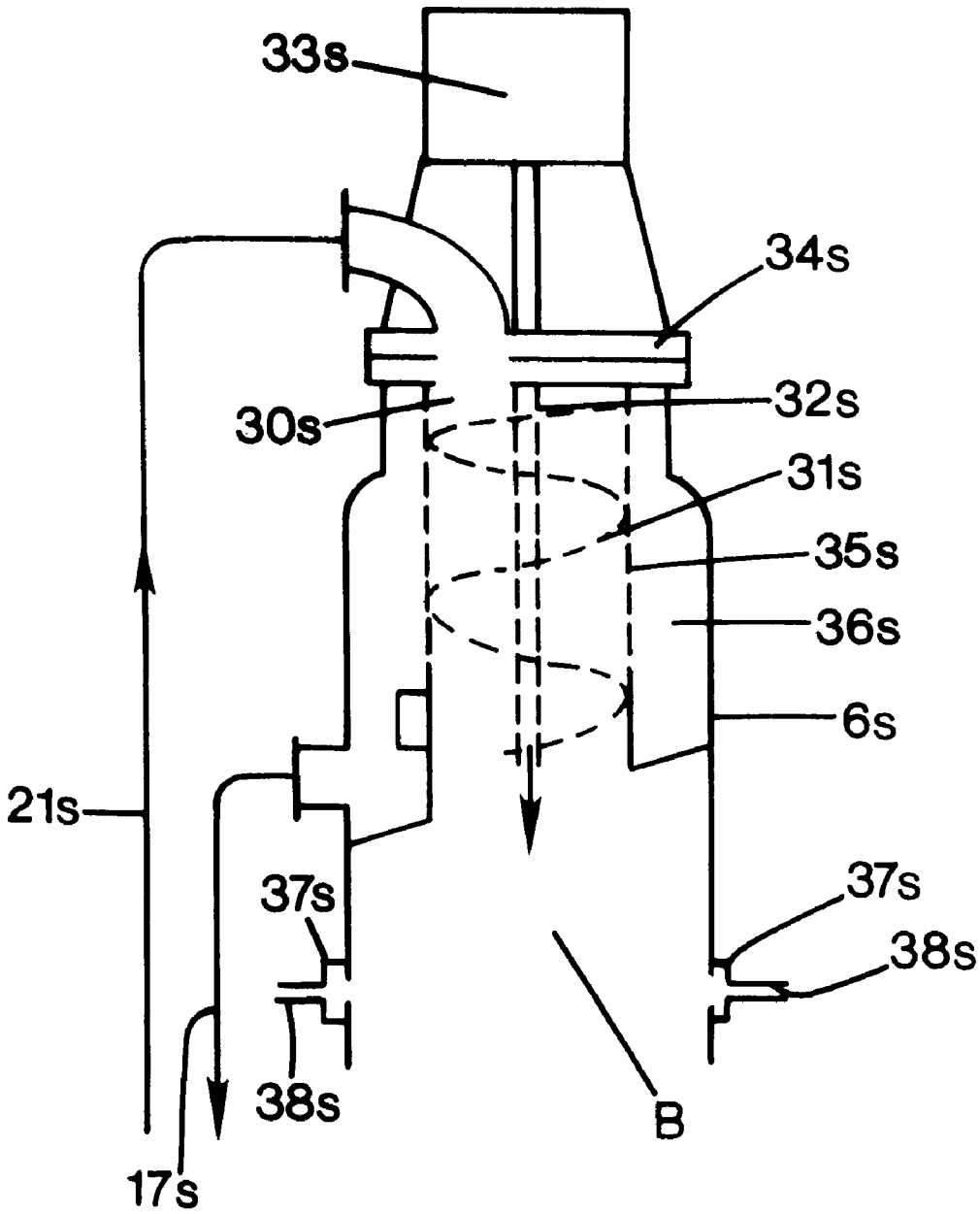
FIG. 4 is a cross-sectional view of a preferred second embodiment of a top separator to be used in an impregnation vessel and/or hydraulic digester according to the present invention.

In FIG. 4, there is shown a preferred second embodiment of a top separator intended for a hydraulic digester or an impregnation vessel according to the present invention. Only a part of the top of the digester 6*s* is shown. The slurred fiber material is transferred to the top of the digester by means of a transfer line 21*s* and enters an in-let space 30*s* of a screw-feeder 31*s*. The screw-feeder 31*s* is attached to a shaft 32*s* connected to a drive-unit 33*s* which is attached to a mounting-plate 34*s* at the top of the digester shell 6*s*. The drive-shaft 32*s* is rotated in a direction so as to force the screw to feed the fiber slurry in a downward direction.

A cylindrical screen-basket 35*s* surrounds the screw-feeder 31*s*. The screen-basket 35*s* is arranged within the digester shell 6*s* so as to form a liquid collecting space 36*s* between the digester shell and the outer surface of the screen-basket 35*s*. The liquid collecting space 36*s*, which preferably is annular, communicates with a conduit 17*s* for withdrawing liquid from the liquid collecting space 36*s*, which in turn is replenished by liquid from the slurry within the screen basket 35*s*. The major part of the free liquid within the slurry entering the screen basket is withdrawn into the liquid collecting space 36*s*, but a small portion of free liquid, at least about 0.5 $m^3$/ADT should not be withdrawn from the slurry.

Below the outlet end of the screen basket 35*s* there is arranged a pair of liquid supply devices 37*s*, each preferably comprising an annular distribution ring which opens up into the chips pile for supply of liquid into the fiber material moving down into the digester 6*s*. The liquid supply devices 37*s* are replenished by means of lines 38*s* wherein a desired amount of liquid is supplied. If it is a two-vessel hydraulic digester system, the liquid supplied through the liquid supply devices 37*s* into a concurrent cooking zone B would be hot cooking liquor having a relatively high amount of effective alkaline, in order to provide for the possibility of establishing the concurrent cooking zone B having a desired cooking temperature and a desired content of effective alkaline.

Figure 5:
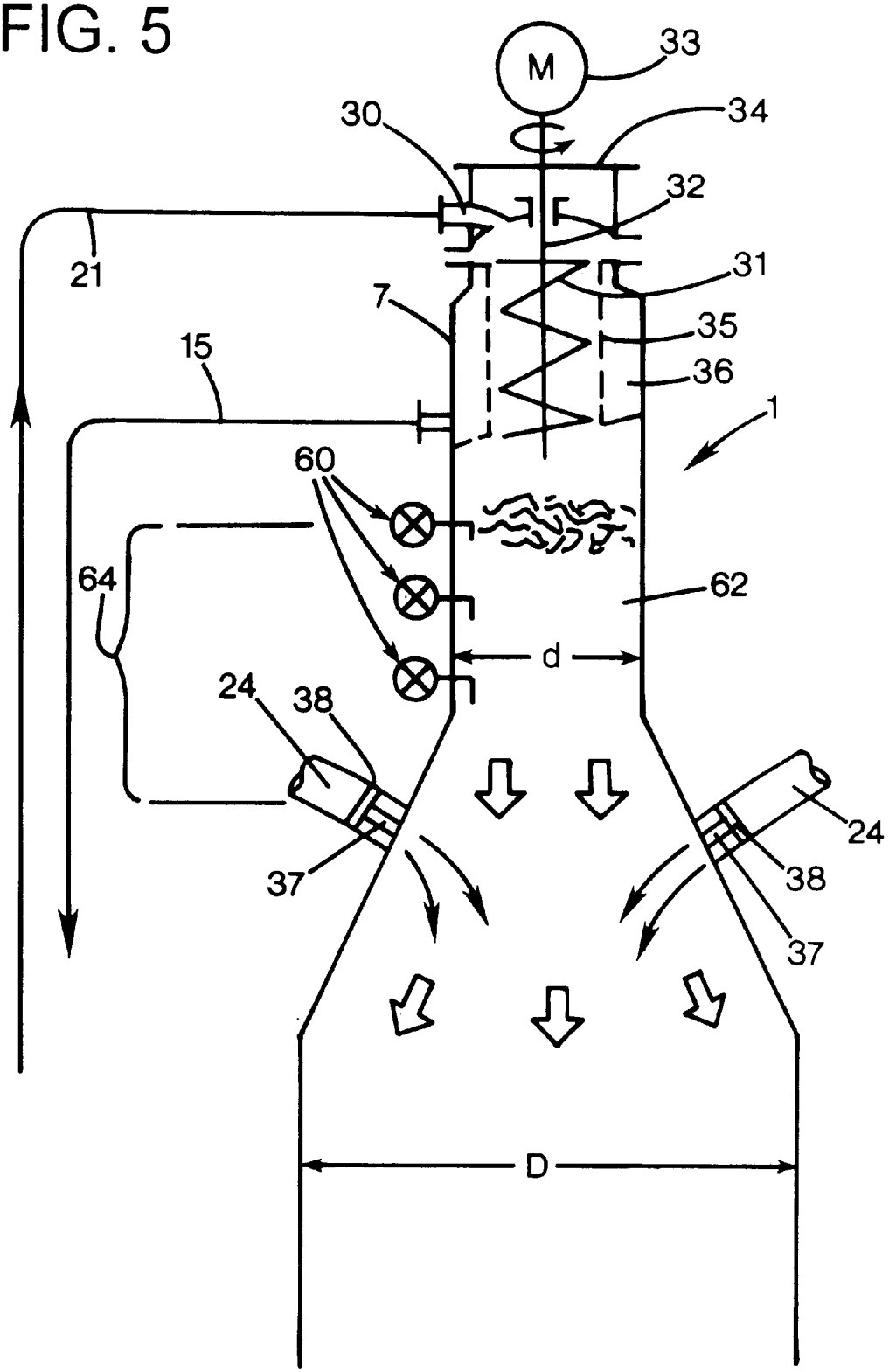
FIG. 5 is a cross-sectional view of a preferred third embodiment of a top separator to be used in an impregnation vessel and/or hydraulic digester according to the present invention.

FIG. 5 shows a preferred third embodiment of a separator to be used together with a hydraulic digester or an impregnation vessel 1 that is part of a digester system, such as the digester system shown in FIG. 1, where there is a need for a heat seal. The advantage of providing the heat seal adjacent the separator is to enable the injection of hot black liquor (above 100° C.) into the top of the vessel without risking to operate the high pressure feeder at too high of a temperature. The heat seal reduces or even eliminates the risk of any hot liquor being inadvertently conducted back to through the top separator and to the high pressure feeder which may damage the feeder. The separator may also be used in a single vessel hydraulic digester if required. Only a top portion of such an impregnation vessel 1 or a digester is shown. The non-impregnated slurred fiber material is transferred to the top of the impregnation vessel or the digester by means of the transfer line 21 and enters an inlet space 30 of a screw-feeder 31. The screw-feeder 31 is attached to a shaft 32 connected to a drive-unit 33 which is attached to a mounting-plate 34 at the top of the vessel shell 1. The drive-shaft 32 is rotated in a direction so as to force the screw to feed the chips and the transport fluid in a downward direction.

A cylindrical screen-basket 35 surrounds the screw-feeder 31. The screen-basket 35 is arranged within the vessel shell 1 so as to define a liquid collecting space 36 between the digester shell and the outer surface of the screen-basket 35. The liquid collecting space 36, which preferably is annular, communicates with a conduit 15 for withdrawing liquid from the liquid collecting space 36, which in turn is replenished by liquid from the slurry within the screen basket 35. The major part of the free liquid within the slurry entering the screen basket is withdrawn into the liquid collecting space 36, but a small portion of free liquid, at least about 0.5 $m^3$/ADT should not be withdrawn from the slurry.

A set of level sensors 60 is positioned along a side wall of the vessel 1 to sense the level in the vessel. The level sensors are disposed below the screw-feeder 31 but above the pair of liquid supply devices 37. A top section 62 of the vessel 1 has a diameter (d) that is less than a diameter (D) of the vessel at a mid-portion and bottom portion thereof. The diameter (d) is small to reduce or even avoid any substantial heat transfer to the return line leading to the high pressure feeder so that the maximum temperature is slightly below the boiling temperature of the liquid in the chip chute. The boiling temperature is dependent on the pressure in the chip chute. In this way, a heat lock zone 64 is formed between the liquid supply devices 37 (for supplying hot black liquor) and the liquid collecting space 36.

The liquid supply devices 37 preferably comprise an annular distribution ring 38 which has a number of supply conduits disposed between the ring 38 and the vessel 1. The supply conduits 37 open up into the chips pile for supplying liquid into the fiber material moving down into the vessel 1. The annular distribution ring 38 is replenished by means of the conduit 24 wherein a desired amount of liquid is supplied. The liquid supplied through the liquid supply device 37 and annular ring 38 may be hot black liquor having a relatively high amount of effective alkaline, in order to provide for the possibility of establishing a concurrent impregnation zone (A) having a desired temperature of about 120° C. to 145° C., and a desired content of effective alkaline, of about 10–20 g/l.

Figure 6:
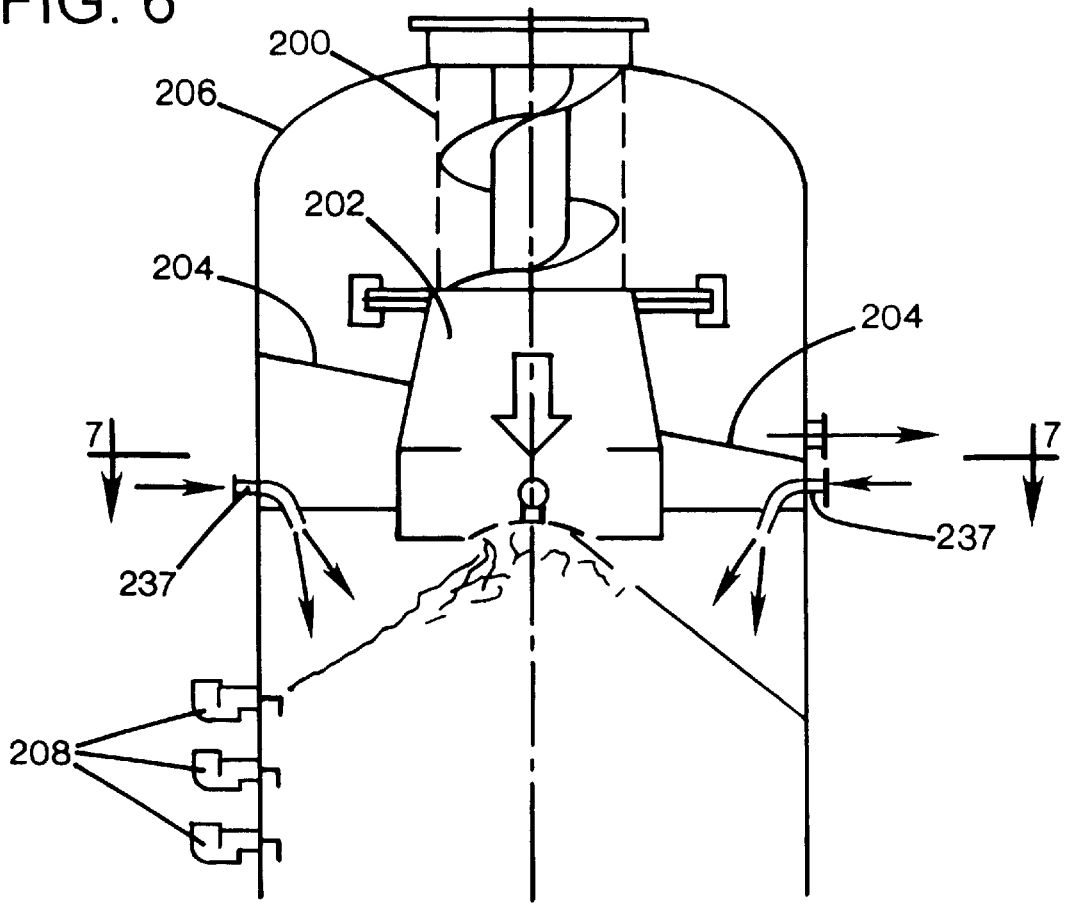
FIG. 6 is a cross-sectional view of a preferred fourth embodiment of a top separator to be used in an impregnation vessel and/or hydraulic digester according to the present invention.
Figure 7:
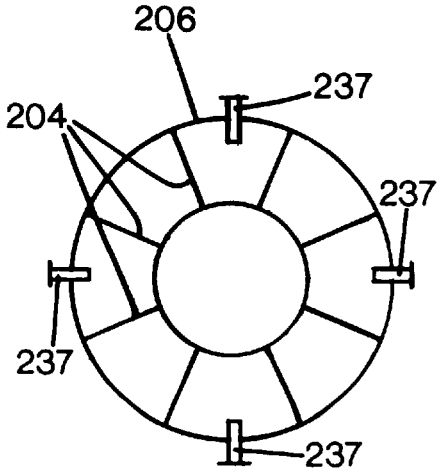
FIG. 7 is a top view along line 6—6 of the top separator shown in FIG. 6.

FIGS. 6–7 illustrate a preferred fourth embodiment of a top separator of the present invention. Similar to the earlier described embodiments of the separators, this alternative embodiment has a screw feeder that feeds the fiber material and the transport liquid downwardly through the separator, only some of the most important features of this embodiment are described herein.

The separator 200 is mounted in a vessel 206 having cupped gables and the separator 200 has an extension portion 202 that extends downwardly from the separator 200. A plurality of separation plates 204 extend from the separator 200 to an inner wall of a vessel 206. The extension portion 202 reduces the risk of any undesirable back flow of the black liquor into the separator 200. A set of supply devices 237 are disposed between the separation plates 204. The supply devices 237 each have a downwardly bent conduit section to further reduce the risk of a undesirable back-flow and to permit the black liquor to flow in a downward direction that is concurrent with a flow of the fiber material that has been fed through the top separator 200. Similar to the embodiment illustrated in FIG. 5, a set of level sensors 208 are disposed at the inner wall of the vessel 206. However, the level sensors 208 are disposed below the supply devices 237 as opposed to above the supply devices as shown in FIG. 5.

A major advantage of the shown separation devices is that they provide for establishing a distinguished change of zones (they enable almost a total exchange of free liquid at this point), which means that the desired conditions in the beginning of the concurrent zone can easily be established.

Figure 8:
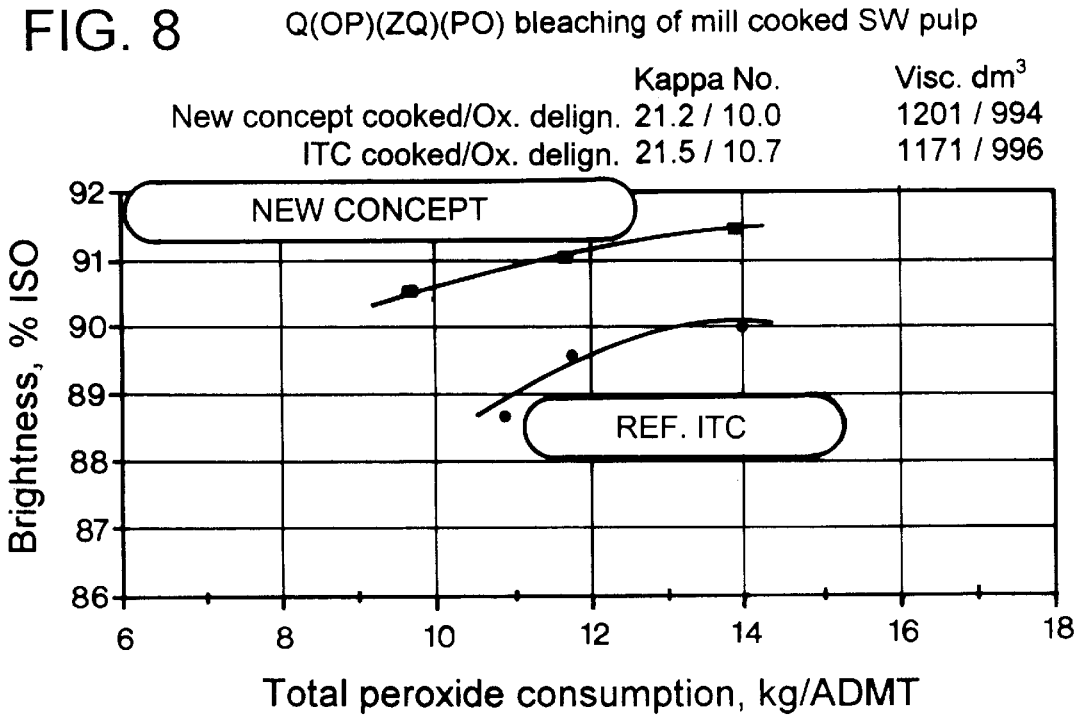
FIG. 8 shows test data related to peroxide consumption and brightness for the present method compared to a conventional process.

FIG. 8 shows results from a TCF bleaching using the cooking process, illustrated as the new concept, of the present invention compared to a conventional ITC reference cooking process. The present invention provides a TCF-bleached pulp having extremely good bleachability and a higher brightness is achieved compared to the conventional process for the same amount of peroxide consumption, and also a higher brightness ceiling is obtained.

Figure 9:
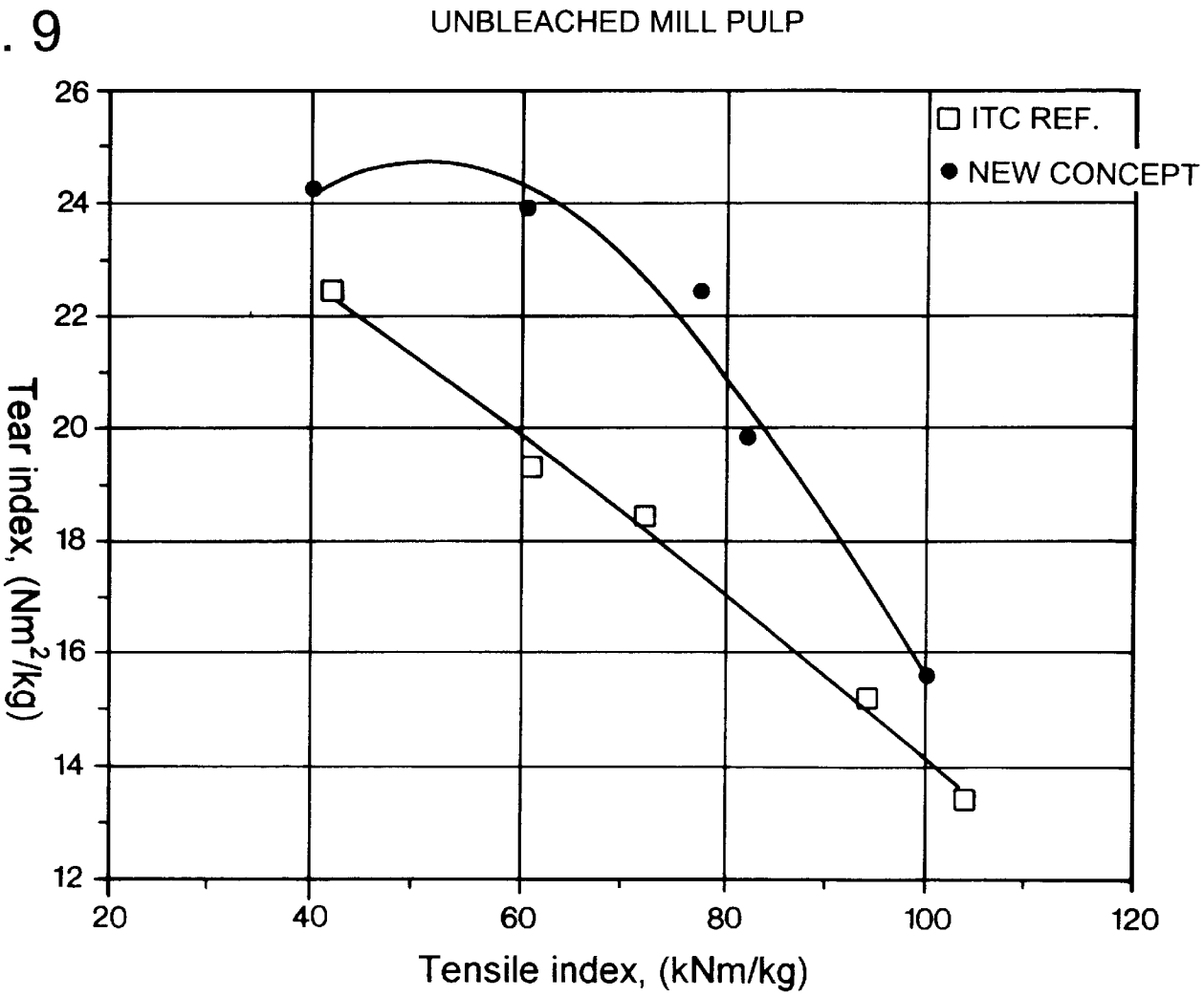
FIG. 9 shows test data related to tensile index and tear index for unbleached pulp according to the present method compared to a conventional process.

FIG. 9 shows the tear index relative to the tensile index. The new concept of the present invention provides a higher tear index relative to the tensile strength compared to a conventional ITC cooking process.

Figure 10:
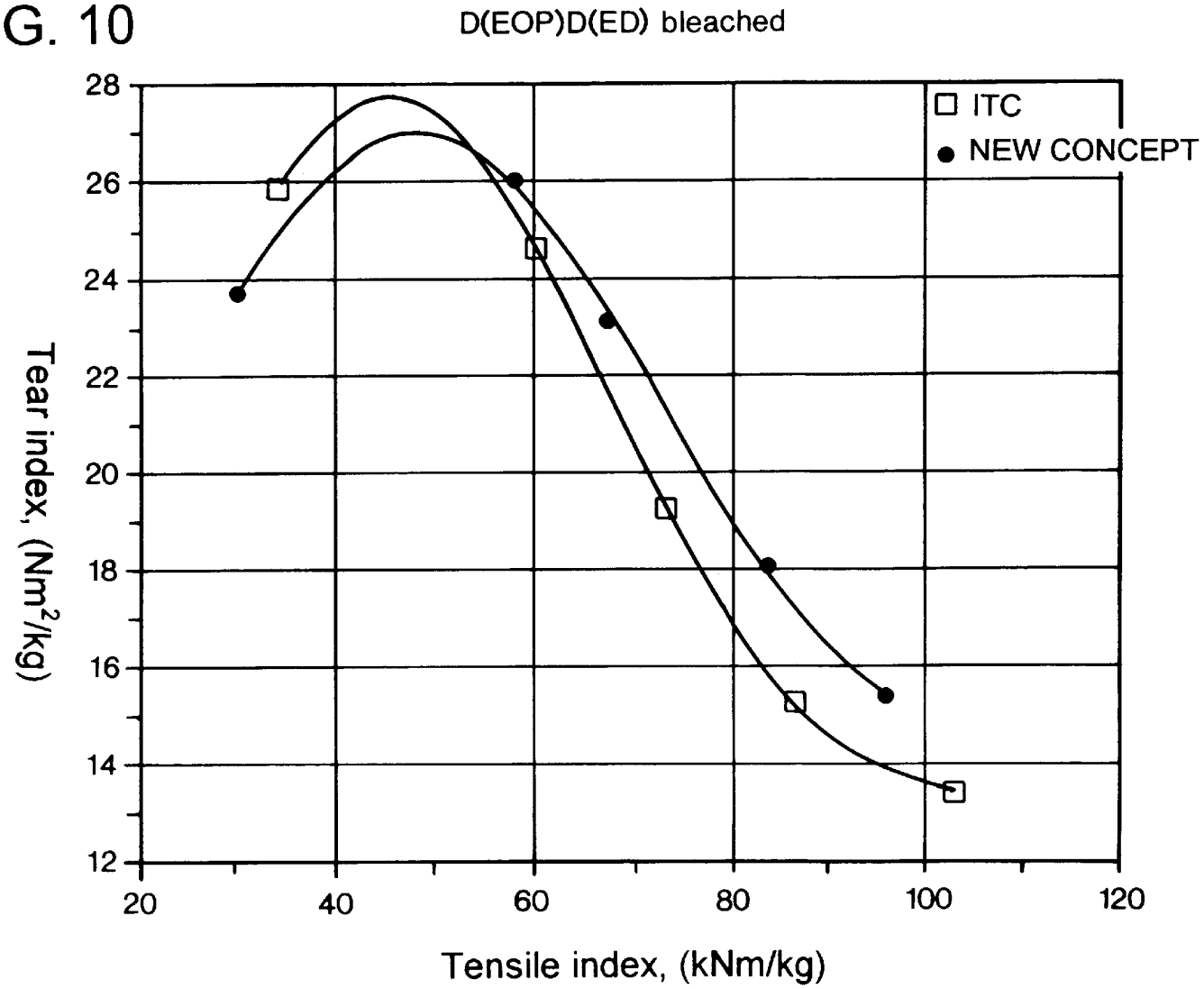
FIG. 10 shows test data related to tensile index and tear index for bleached pulp according to the present method compared to a conventional process.

Similarly, FIG. 10 illustrates test data for the present invention, illustrated as the new concept, compared to a conventional reference ITC-digester. The present invention exhibits better tensile index compared to the conventional method for bleached pulp.

Figure 11:
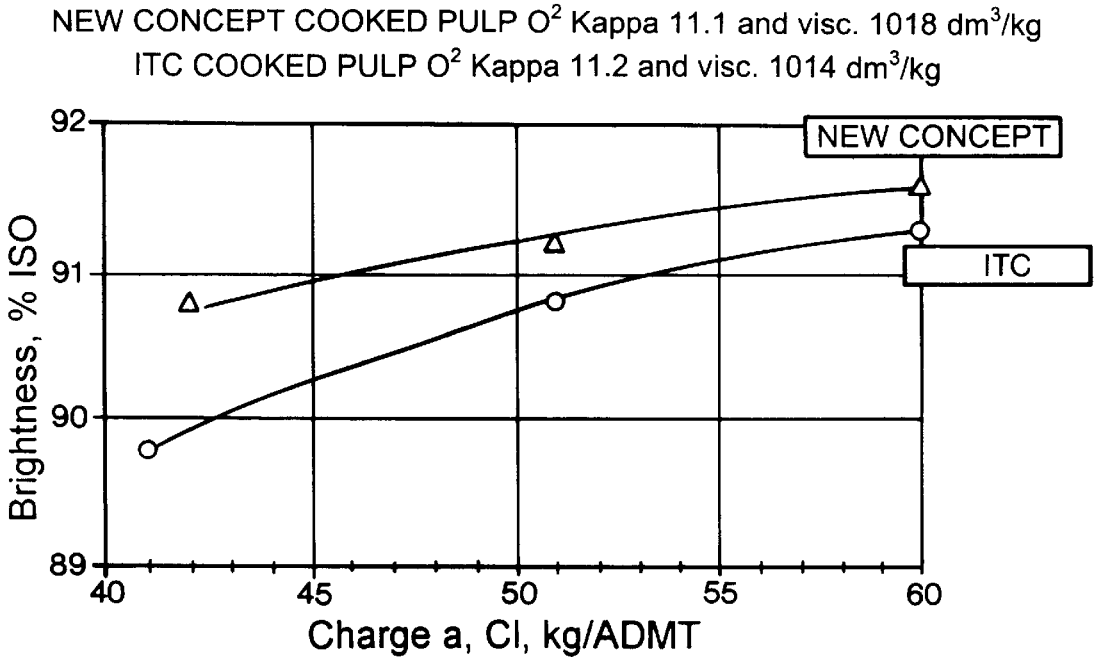
FIG. 11 shows test data related to Cl charge and brightness for the present method compared to a conventional process.

FIG. 11 shows the brightness level by using the present invention, illustrated as the new concept, compared to a conventionally cooked pulp using the ITC process. As is evident, the cooking process of the present invention results in a pulp that is much easier to bleach compared to the conventional cooking process, i.e. the present invention requires less chemicals at a given brightness. The new cooking concept of the present invention also provides a higher brightness ceiling.

When cooking in mill scale according to the new concept of the present invention, the following significant advantages are gained in comparison to a conventional ITC-cooking.

When cooking softwood:

Increased tear strength by 10%;

Unchanged beatability;

Improved viscosity by 40 units at kappa number 22;

Increased brightness of unbleached pulp by 2% ISO units;

Increased brightness ceiling of bleached pulp by 0.5% to 1% ISO unit;

Lowered $H_2O_2$ consumption by 15% to 20%;

Reduced knot content by 60%;

Reduced shive content by 55%;

Reduced MP-steam consumption in digester by 10% to 15%.

When cooking hardwood:

Increased tensile index at 500 PFI-revolutions by 8%;

Increased tensile stiffness at 500 PFI-revolution by 8%;

Improved viscosity by 50 units at kappa number 15;

Increased brightness ceiling;

Lowered $H_2O_2$ consumption by 15%;

Reduced knot content by 55%;

Reduced shive content by 50%;

Reduced alkali charge by 10%.

Figure 12:
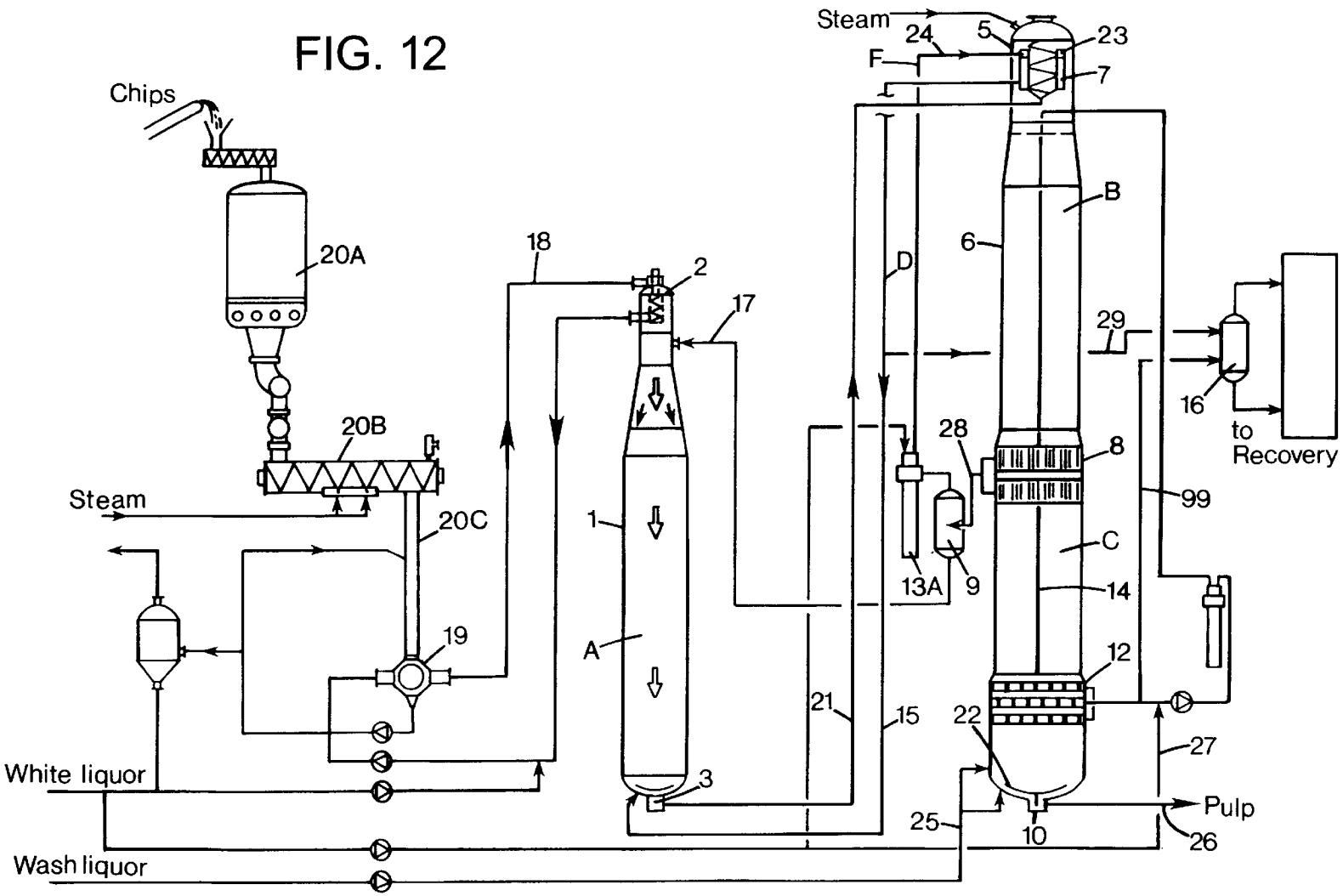
FIG. 12 is a schematic flow diagram of a preferred alternative embodiment of a two vessel cooking system according to the present invention.

FIG. 12 shows a way of running the process of the present invention in connection with an overloaded two vessel steam/liquid digester. Due to the overload (normally more than 30 ADMT pulp/hour and $m^2$ in the final cooking zone C) such a digester 6 normally has difficulties to obtain a sufficient up-flow in the so called counter-current cooking zone. The final cooking zone C will therefore be in form of a concurrent final cooking zone C. To run according to the invention this requires a withdrawal strainer 12 positioned close to the bottom of the digester 6 and the retrofitting of a withdrawal line 99 that extends from a conduit 11 that is connected to the strainer to a flash tank 16 to be further conveyed to a recovery unit. FIG. 12 is almost identical to FIG. 1 (no retro-fit), except for the withdrawal line 99 which transfers liquor withdrawn from the lowermost screen 12 to a recovery unit. However, a major (more than 50%) portion of the liquor that is conducted to the recovery unit is still taken from the return line 15 via a connecting conduit 29 that extends to the flash tank 16. The process preferably leads to a higher wood/liquid ratio in the impregnation zone A of the impregnation vessel 1 than in the con-current cooking zone B of the digester 6 that may have a higher wood/liquid ratio than the final cooking zone C, i.e. w/l of zone A>w/l of zone B>w/l of zone C. In order to achieve a cold blow (below 100° C. in the blow line 26) it may be necessary to add a sufficient amount of cold wash liquor conducted in a conduit 25 at a point that is adjacent the bottom of the digester 6. The wash liquor is normally supplied by means of nozzles, and sometimes preferably also through the scraper 22 disposed at the bottom of the digester 6. The wash liquor in the conduit 25 may partly flow upwards and displace the hot cooking liquor in the pulp that is moving downwardly below the screen 12, and partly go out in the blowline 26 together with the pulp. If desired, some wash liquor may be added by means of the central pipe 14 disposed inside the digester 6 in order to radially displace hot cooking liquor. Alternatively, the latter may be achieved by means of a stand pipe that extends upwardly from the bottom of the digester 6. This method may also be used in connection with digesters that are not overloaded but that have problems with keeping a sufficient up-flow (normally recommended to be at least 1.5 $m^3$/ADMT pulp dilution factor for counter current cooking) in the final cooking stage.

Figure 13:
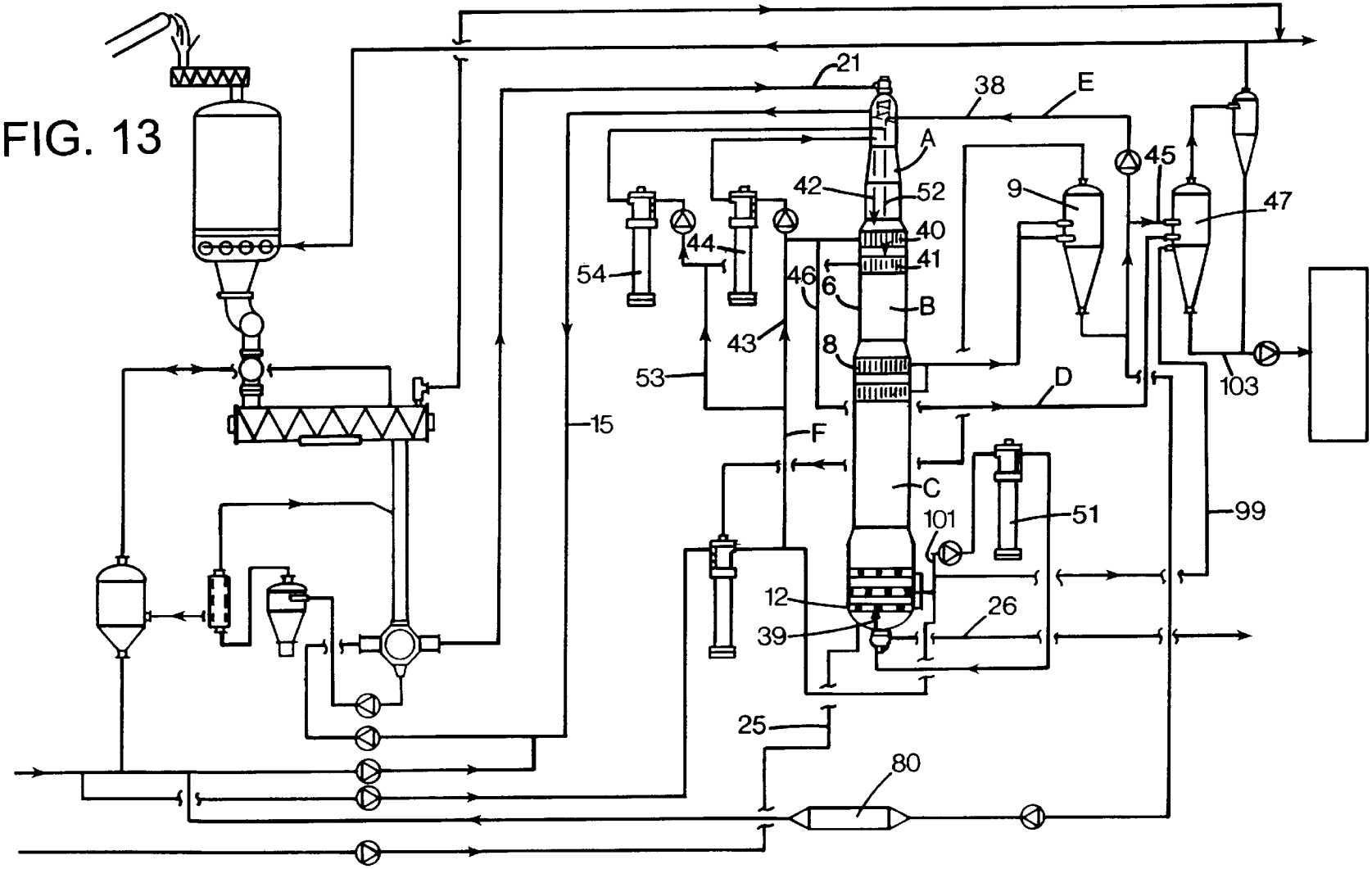
FIG. 13 is a schematic flow diagram of a preferred alternative embodiment of a single vessel cooking system according to the present invention.

FIG. 13 shows a way of running the process in connection with an overloaded single vessel hydraulic digester. FIG. 13 is almost identical to FIG. 3 (no retro-fit), except for a withdrawal line 99 that transfers liquor withdrawn from the lowermost screen 12 to recovery. More particularly, the line 99 has one end connected to a conduit 101 and an opposite end connected to a flash tank 47. The flash tank 47 has a conduit 103 that leads to a recovery unit. As mentioned above, in an overloaded digester, the upward flow in the counter-current zone C is often insignificant to the downward flow in the concurrent zone (B) of the overloaded digester. The method of operating the digester in the lowermost zone (C) of FIG. 13 is virtually identical to the method described in connection with FIG. 12.

With regard to the temperatures used when running overloaded digesters as described in FIGS. 12–13, it should be noted that the temperatures in the cooking zones are related to the retention time of the cooking zones that in turn corresponds to the H-factor. As already mentioned, the new concept of the present invention leads to a lower H-factor demand compared to conventional methods and digesters. However, since an overloaded digester has a production rate exceeding its nominal dimensions, the retention time will be reduced. If the same temperature would be maintained in the cooking zones as calculated for its nominal production this would lead to a reduced H-factor which may result in an insufficient Kappa reduction. Accordingly in connection with overloaded digesters it may be preferred or even necessary to increase the temperatures in the cooking zones to achieve the desired kappa reduction. The increase of the temperatures may be as high as 15° C., preferably about 10° C., compared to the nominal temperature according to the new concept of the present invention.

While the present invention has been described in accordance with preferred compositions and embodiments, it is to be understood that certain substitutions and alterations may be made thereto without departing from the spirit and scope of the following claims.

What is claimed is:

1. A method for continuously producing pulp, comprising the steps of:

providing a finely divided fiber material, a transport liquid and an impregnation zone;

providing a vessel to facilitate a cooking reaction, the vessel having at least two strainer girdle sections, one of the strainer girdle sections being disposed immediately adjacent a bottom portion of the vessel;

providing a concurrent cooking zone and a lowermost cooking zone disposed in the vessel, the vessel lacking a distinguished counter-current cooking zone;

providing an amount of cooking liquor required for the cooking reaction;

transporting the fiber material and the transport liquid to the impregnation zone;

withdrawing an amount of hot spent liquor from at least one of the strainer girdle sections, the hot spent liquor having an effective alkali level of at least 13 grams per liter;

transferring a substantial portion of the amount of the hot spent liquor to the impregnation zone so that no substantial amount of the hot spent liquor is directly recirculated to the concurrent cooking zone;

heating the fiber material disposed in the impregnation zone to an impregnation temperature and thoroughly impregnating the fiber material by exposing the fiber material to the hot spent liquor;

passing the fiber material through the impregnation zone in a direction that is concurrent with a flow direction of the hot spent liquor;

transferring the fiber material from the impregnation zone to the concurrent cooking zone and overloading the vessel;

supplying at least 60% of a total amount of the cooking liquor charged to the digester to the concurrent cooking zone of the vessel;

obtaining a first effective alkaline level in the concurrent cooking zone that is at least 20 grams per liter;

transferring the fiber material from the concurrent cooking zone to the lowermost cooking zone of the vessel;

passing the fiber material through the lowermost cooking zone without any substantial counter current flow in the vessel;

removing pulp from the bottom portion of the vessel;

maintaining a cooking temperature in the lowermost cooking zone, the lowermost cooking zone temperature being greater than the impregnation temperature;

passing a first portion of the spent liquor having passed through the impregnation zone to a recovery unit; and passing a second portion of the spent liquor withdrawn from one of the strainer girdle sections to the recovery unit.

2. The method according to claim 1 wherein the method further comprises the steps of providing a central pipe disposed in the vessel and supplying a washing liquid to the bottom portion of the vessel and into the central pipe and displacing the washing liquid radially from the central pipe to one of the strainer girdle sections.

3. The method according to claim 1 wherein the method further comprises the steps of obtaining a first liquid/wood ratio in the impregnation zone and obtaining a second liquid/wood ratio in the con-current cooking zone, the first liquid/wood ratio is greater than the second liquid/wood ratio.

4. The method according to claim 3 wherein the method further comprises the step of providing the vessel with a final cooking zone, the final cooking zone has a third liquid/wood ratio, the second liquid/wood ratio is greater than the third liquid/wood ratio.

5. The method according to claim 3 wherein the first liquid/wood ratio in the impregnation zone is between about 2/1 and about 10/1.

6. The method according to claim 3 wherein the first liquid/wood ratio in the impregnation zone is between about 4/1 and about 9/1.

7. The method according to claim 3 wherein the first liquid/wood ratio in the impregnation zone is between about 5/1 and about 8/1.

8. The method according to claim 1 wherein step of passing the spent liquor withdrawn from one of the strainer girdles section further comprises the step of transferring a major portion of the spent liquor to the recovery unit.

9. The method according to claim 1 wherein the step of transferring the spent liquor to the impregnation zone comprises the step of transferring an amount of the spent liquor to the impregnation zone that exceeds 6 m3/ADT.

10. The method according to claim 9 wherein the step of transferring comprises transferring an amount of spent liquid or that exceeds about 7 m3/ADT.

11. The method according to claim 9 wherein the step of transferring comprises transferring an amount of spent liquor that is between about 8 m3/ADT and about 12 m3/ADT.

12. The method according to claim 1 wherein the method further comprises the steps of exchanging a liquid between the impregnation zone and the concurrent cooking zone and leaving a maximum of 1.5 m3/ADT of the non-exchanged liquid in a slurry that is transferred from the impregnation zone to the concurrent cooking zone.

13. The method according to claim 12 wherein the step of leaving comprises the step of leaving a maximum of 1 m3/ADT in the slurry.

14. The method according to claim 12 wherein the step of leaving comprises the step of leaving a maximum of 0.5 m3/ADT in the slurry.

15. The method according to claim 1 wherein the method further comprises maintaining the cooking temperature at below 170 degrees Celsius.

16. The method according to claim 15 wherein the step of maintaining the cooking temperature comprises the step of maintaining the cooking temperature at between about 150 degrees Celsius and about 170 degrees Celsius.

17. The method according to claim 1 wherein the step of withdrawing the hot spent liquor further comprises the step of withdrawing a hot spent liquor having an effective alkaline level that is at least 16 grams per liter.

18. The method according to claim 1 wherein the step of withdrawing the hot spent liquor comprises the steps of withdrawing a hot spent liquor having an effective alkaline level that is at least 18 grams per liter.

19. The method according to claim 1 wherein the step of withdrawing the hot spent liquor comprises the steps of withdrawing a hot spent liquor having an effective alkaline level that is at least 20 grams per liter.

20. The method according to claim 1 wherein the step of obtaining the first effective alkaline level comprises the step of obtaining an effective alkaline level that exceeds 40 grams per liter.

21. The method according to claim 1 wherein the step of obtaining the first effective alkaline level comprises the step of obtaining an effective alkaline level that is between 45 grams per liter and 55 grams per liter.

22. The method according to claim 1 wherein the step of withdrawing the hot spent liquor further comprises the step of supplying the hot spent liquor to the impregnation zone when a substantial portion of the hot spent liquor has a temperature that exceeds about 100 degrees Celsius.

23. The method according to claim 1 wherein the step of withdrawing hot spent liquor comprises the step of supplying the hot spent liquor to the impregnation zone when a substantial portion of the hot spent liquor has a temperature of between about 120 degrees Celsius and about 170 degrees Celsius.

24. The method according to claim 1 wherein the step of withdrawing hot spent liquor comprises the step of supplying the hot spent liquor to the impregnation zone when a substantial portion of the hot spent liquor has a temperature of between about 130 degrees Celsius and about 160 degrees Celsius.

25. The method according to claim 1 wherein the step of withdrawing the hot spent liquor further comprises the steps of passing the hot spent liquor through a first flash tank and then conveying the hot spent liquor to the impregnation zone.

26. The method according to claim 1 wherein the method further comprises the step of providing an impregnation vessel and the step of withdrawing the hot spent liquor having passed through the concurrent cooking zone comprises the step of supplying at least 70% of the hot spent liquor withdrawn to an inlet of the impregnation vessel.

27. The method according to claim 26 wherein the step of supplying the hot spent liquor comprises the step of supplying at least 80% of the hot spent liquor withdrawn to the impregnation vessel.

28. The method according to claim 26 wherein the step of supplying the hot spent liquor comprises the step of supplying between about 90% and about 100% of the hot spent liquor withdrawn to the impregnation vessel.

29. The method according to claim 26 wherein the method further comprises the step of conveying a portion of the hot spent liquor directly to a recovery system after the hot spent liquor has been separated from the fiber material and a liquid stream has been removed from the impregnation vessel.

30. The method according to claim 1 wherein the step of providing a vessel comprises the step of providing a steam/vapor-phase digester having a top separator including a screw that feeds upwardly.

31. The method according to claim 1 wherein the step of passing the second portion of the spent liquor comprises the step of passing the second portion of the spent liquor withdrawn from the strainer girdle section that is adjacent the bottom portion.

32. The method according to claim 1 wherein the first portion of the spent liquor is greater than the second portion of the spent liquor.

* * * * *